United States Patent [19]

Creutz, deceased et al.

[11] 4,110,176

[45] Aug. 29, 1978

[54] ELECTRODEPOSITION OF COPPER

[75] Inventors: Hans-Gerhard Creutz, deceased, late of Yale, Mich., by Katharina A. Creutz, administratrix; Roy Wilbur Herr, Troy, Mich.

[73] Assignee: Oxy Metal Industries Corporation, Warren, Mich.

[21] Appl. No.: 793,701

[22] Filed: May 4, 1977

Related U.S. Application Data

[63] Continuation-in-part of Ser. No. 557,443, Mar. 11, 1975, abandoned.

[51] Int. Cl.[2] ..... C25D 3/38

[52] U.S. Cl. ..... 204/52 R; 204/44; 260/29.2 EP; 528/424

[58] Field of Search ..... 204/52 R, 52 Y, 44, 204/105–107; 106/1; 260/2 BP, 2 EN, 29.2 EP

[56] References Cited

U.S. PATENT DOCUMENTS

| | | | |
|---|---|---|---|
| 2,272,489 | 2/1942 | Ulrich | 260/239 |
| 2,296,225 | 9/1942 | Ulrich | 260/239 |
| 3,030,282 | 4/1962 | Passal | 204/52 Y |
| 3,313,736 | 4/1967 | Dickson et al. | 252/321 |
| 3,770,598 | 11/1973 | Creutz | 204/52 R |

FOREIGN PATENT DOCUMENTS

| | | | |
|---|---|---|---|
| 654,840 | 12/1937 | Fed. Rep. of Germany. | |
| 655,742 | 1/1938 | Fed. Rep. of Germany. | |
| 676,407 | 6/1939 | Fed. Rep. of Germany. | |
| 1,151,159 | 7/1963 | Fed. Rep. of Germany | 204/52 R |

*Primary Examiner*—G. L. Kaplan

*Attorney, Agent, or Firm*—B. F. Claeboe; Richard P. Mueller; Arthur E. Kluegel

[57] ABSTRACT

A composition and method for electrodepositing ductile, bright, well leveled copper deposits from an aqueous acidic copper plating bath having dissolved therein from about 0.04 to about 1000 milligrams per liter of a poly (alkanol quaternary ammonium salt) formed as the reaction product of a polyalkanolamine with an alkylating or quaternization agent. The polyalkanolamine constituent typically is formed as the reaction product of a polyalkylenimine (e.g. polyethylenimine) with an alkylene oxide.

6 Claims, No Drawings

ELECTRODEPOSITION OF COPPER

CROSS REFERENCE TO RELATED CASES

This application is a continuation-in-part of Ser. No. 557,443 filed Mar. 11, 1975, now abandoned.

BACKGROUND OF THE INVENTION

This invention relates to the electrodeposition of copper from aqueous acidic plating baths, especially from copper sulfate and fluoroborate baths, and more particularly it relates to the use of certain organic compounds in the baths to give bright, highly ductile, low stress, good leveling copper deposits over a wider range of bath concentration and operating current densities.

In U.S. Pat. No. 3,770,598, assigned to the assignee of the present invention, there has been proposed the addition of certain reaction products to acidic copper plating baths to yield generally the above recited benefits. These prior art additives are formed by the reaction of polyethylenimine with an alkylating agent, such as benzyl chloride. While these reaction products are efficacious in improving the copper deposit, often they may be found to be relatively insoluble in the aqueous acidic plating baths.

SUMMARY OF THE INVENTION

It has been found that improved copper deposits can be obtained from aqueous acidic copper plating baths by the addition thereto of poly (alkanol quaternary ammonium salts). Such salts are more soluble in and more compatible with the aqueous acidic baths as compared with the previously utilized alkylated polyethylenimines of the prior art.

DESCRIPTION OF THE PREFERRED EMBODIMENTS

The composition and method of this invention broadly comprises acidic copper plating baths of either the acidic copper sulfate or acidic copper fluoroborate type. As is known in the art, such acidic copper sulfate baths typically contain from about 180 to 250 grams per liter of copper sulfate and 30 to 80 grams per liter of sulfuric acid; while the acidic copper fluoroborate baths typically contain from about 200 to 600 grams per liter of copper fluoroborate and about 0 to 60 grams per liter of fluoroboric acid. Additionally, it is found that with the additives of the present invention, these acid copper plating baths may be operated under conditions of high acid and low metal content. Thus, even with plating baths which contain as little as about 7.5 grams per liter copper and as much as 350 grams per liter sulfuric acid or 350 grams per liter of fluoroboric acid, excellent plating results are still obtained.

Desirably, these plating baths are operated at current densities within the range of about 10 to 100 amps per square foot, although, in many instances, current densities as low as about 0.5 amps per square foot may also be used. Typically, with low copper and high acid baths, current densities within the range of about 10 to 50 amps/ft$^2$ are used. Additionally, in high agitation baths, such as those used in plating rotogravure cylinders, current densities up to as high as about 400 amps/ft$^2$ may be used. The baths may be operated with air agitation, cathode-rod agitation, or solution agitation and cathode-rod agitation, depending upon the particular bath and plating conditions which are used. Typical bath temperatures are within the range of about 25° to 35° C., although both lower and higher temperatures, e.g., 50° C. or more, may also be used. In this regard, it is to be noted that the plating baths of the present invention may also be used in copper electrorefining processes. In such processes, temperatures up to about 60°–70° C. may be used.

Although it has been found to be desirable that chlorine and/or bromide anions in the bath are below about 0.1 gram per liter, appreciably greater amounts of many inorganic cations, such as ferrous iron, nickel, cobalt, zinc, cadmium, and the like, may be present in the bath, as for example, amounts at least as high as about 25 grams per liter, without detrimental effect. It has further been found that not only do the acid copper plating baths of the present invention give excellent results when used under conditions of high acid and low copper metal content, but, additionally the baths have been found to be particularly well adapted for throughhole plating, and thus, find appreciable utilization in the manufacture of printed circuit board.

The poly (alkanol quaternary ammonium salt) of the present invention may be prepared in a reaction sequence. One step involves the reaction of a mixture of a polyalkylenamine with an alkylene oxide to form a polyalkanolamine. Another step involves the reaction of the polyalkanolamine with an alkylating or quaternization agent to yield a poly (alkanol quaternary ammonium salt). This reaction sequence may be represented as follows:

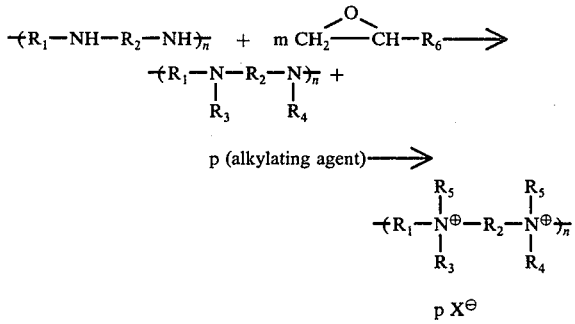

wherein:

$R_1$ = alkylene group of 1–6 carbon atoms;

$R_2$ = alkylene group of 1–6 carbon atoms;

$R_3 = -CH_2-CH(OH)-R_6$ ;

$R_4 = -CH_2-CH(OH)-R_6$ or H;

$R_5$ = alkyl group of 1–4 carbon atoms;

aralkyl;

alkenyl group of 2–4 carbon atoms;

alkynyl group of 2–4 carbon atoms;

alkylene sulfonate group of 1–4 carbon atoms (e.g. $-CH_2CH_2CH_2SO_3^{\ominus}$); and

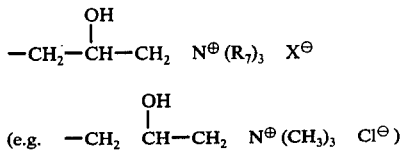

$R_6$ = H, $-CH_3$, $-CH_2OH$;
$R_7$ = alkyl group of 1–4 carbon atoms;
$m$ = 1 to 2;
$X^{\ominus}$ = $Cl^{\ominus}$, $Br^{\ominus}$, $CH_3SO_4^{\ominus}$;
$p$ = 1 to 2;
$n$ = 7.0 to 23,500.

The values of $m$ and $p$ selected must be such that the final product contains some alkanol quaternary ammonium groups. If the value of $p$ is less than 2, it is understood that the number of $R_5$ groups (and quaternary ammonium groups) in the above formula has a corresponding value. When the alkylating agent is an alkanesultone, it is understood that $X^{\ominus}$ of the formula is the sulfonate group ($SO_3^{\ominus}$) attached to the alkylene group.

Specific polyalkylenimines which can be utilized may be expressed as the polymerization product of:

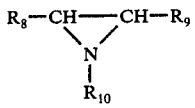

wherein $R_8$ and $R_9$ may be hydrogen, alkyl of from one to three carbon atoms, and $R_{10}$ may be hydrogen, alkyl, aralkyl, or hydroxy alkyl of from one to three carbon atoms. The preferred polyalkylenimine is unsubstituted polyethylenimine, ranging in molecular weight from about 300 to about 1,000,000.

Specific alkylene oxides which can be utilized are ethylene oxide, propylene oxide and glycidol which are reacted with polyethylenimines to yield products ranging in molecular weight from about 300 to about 1,000,000, in which case in the structural formula set forth above, "$n$" has a value of 7.0 to 23,500. The polyalkylenimine alkylene oxide reaction products or polyalkanolamines when reacted with an alkylating agent give products which are soluble in the acidic copper plating bath, the reaction products from ethylene oxide and glycidol being more soluble than those from propylene oxide.

Various organic compounds can be reacted with the polyalkanolamines to alkylate the nitrogen thereof and to form the reaction products added to the baths of the present invention.

Specific compounds which have been found to give particularly good results are benzyl chloride, allyl bromide, dimethyl sulfate, propanesultone, and (3-chloro-2 hydroxypropyl) trimethyl ammonium chloride or $[Cl—CH_2—CHOH—CH_2—N(CH_3)_3]^+Cl^-$.

The formation of the reaction product is relatively simple. It is only necessary to dissolve the requisite amount of polyalkanolamine in hot water, add the desired amount of alkylating agent, and heat the reaction mixture to a temperature from about 50° C. to about approximately 100° C. The ratio of the polyalkanolamine to alkylating agent may be varied, so that not all of the amino groups of the polyalkanolamine are alkylated. To illustrate the invention further, and assuming N-(2-hydroxyethyl)polyethylenimine and benzyl chloride as the reaction ingredients, the following is believed to take place:

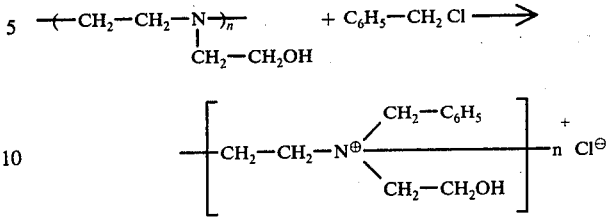

In addition to the above described brightening agent, the aqueous acid copper plating baths of the present invention also desirably contain at least one bath soluble polyether compound. Various polyether compounds which are soluble in the plating bath may be used. For example, particularly in high sulfuric acid and low copper metal baths, non-ionic polyether wetting agents, such as polygycols having carbon chains greater than 6 in length, may be useful. In general, however, the most preferred polyethers are those containing at least six ether oxygen atoms and being free from alkyl chains having more than six carbon atoms in a straight or branched chain. Of the various polyether compounds which may be used, excellent results have been obtained with the polypropylene propanols and glycols of average molecular weight of from about 360 to 1,000, i.e., polyethers which contain a group $(C_3H_6O)_y$ where $y$ is an integer of from about 6 to 20. Excellent results have also been obtained with polyethers containing the group $(C_2H_4O)_x$ where $x$ is an integer of at least 6. Exemplary of the various preferred polyether compounds which may be used are those set forth in Table II appearing in Columns 5 and 6 of U.S. Pat. No. 3,328,273. Desirably, the plating baths of the present invention contain these polyether compounds in amounts within the range of about 0.01 to 5 grams per liter, with the lower concentrations generally being used with the higher molecular weight polyethers.

In addition to the polyethylenimine reaction product and the polyether compound, the aqueous acidic copper plating baths of the present invention also desirably contain an organic divalent sulfur compound. Typical of the suitable organic divalent sulfur compounds which may be used are sulfonated organic sulfides, i.e., organic sulfide compounds carrying at least one sulfonic group. These organic sulfide sulfonic compounds may also contain various substituting groups, such as methyl, chloro, bromo, methoxy, ethoxy, carboxy and hydroxy, on the molecules, especially on the aromatic and heterocyclic sulfide sulfonic acids. The organic sulfide sulfonic acids may be used as the free acids, the alkali metal salts, organic amine salts, or the like. Exemplary of specific sulfonate organic sulfides which may be used are those set forth in Table I in Columns 5 and 6 and Columns 7 and 8 of U.S. Pat. No. 3,267,010. Other suitable organic divalent sulfur compounds which may be used are mercaptans, thiocarbamates, thiolcarbamates, thioxanthates, and thiocarbonates which contain at least one sulfonic group. Additionally, organic polysulfide compounds may also be used. Such organic polysulfide compounds may have the formula $XR_1—(S)_nR_2SO_3H$, wherein $R_1$ and $R_2$ are the same or different alkylene group containing from about 1 to 6 carbon atoms, X is hydrogen or $SO_3H$ and $n$ is a number from about 2 to to 5. These organic divalent sulfur compounds are aliphatic polysulfides wherein at least two divalent sulfur atoms are vicinal and wherein the molecule has one or two terminal sulfonic acid groups. The alkylene portion of the molecule may be substituted with groups such as methyl, ethyl, chloro, bromo, ethoxy, hydroxy, and the like. These compounds may be added as the free acids or as the alkali metal or amine salts. Exemplary of specific organic polysulfide compounds which may be used are set forth in Table I of Column 2 of U.S. Pat. No. 3,328,273. Desirably, these organic sulfide compounds are present in the plating baths of the present invention in amounts within the range of about 0.0005 to 1.0 grams per liter.

The following specific examples of reaction products and their manner of preparation and of specific plating baths and their operation are presented as exemplary of the present invention, and not by way of limitation. Exemplary methods of preparation may be found in a series of German patents in the name of Ulrich, namely, 655,742; 656,934; 676,407; 654,840 and others.

PREPARATION OF REACTION PRODUCTS (a) A mixture of:

109 parts of ethoxylated polyethylenimine (mol. wt. about 1,200 prepared with a 1:1 mole ratio of ethylene oxide to polyethylenimine polymer repeat unit)

was dissolved in 500 parts of water, to this solution was added 64 parts of benzyl chloride at 80°-90° C.

This reaction mixture was heated at 90° C. for 5 hours and heating was continued at 70° C. for 19 hours. The reaction product was cooled and diluted to one liter.

(b) The identical mixture and procedure of (a) above was repeated, but with ethoxylated polyethylenimine of about 3600 molecular weight.

(c) The identical mixture and procedure of (a) above was repeated, but with ethoxylated polyethylenimine of about 120,000 molecular weight.

(d) A mixture of:

146 parts of propoxylated polyethylenimine (mol. wt. about 1,000 prepared with a 1:2 mole ratio of propylene oxide to polyethylenimine polymer repeat unit)

was dissolved in 500 parts of water, to this solution was added 64 parts of benzyl chloride at 80°-90° C.

This reaction mixture was heated at 90° C. for 5 hours and heating was continued at 70° C. for 19 hours. The reaction product was cooled and diluted to one liter.

(e) A mixture of:

109 parts of propoxylated polyethylenimine (mol. wt. about 3,000 prepared with a 1:1 mole ratio of propylene oxide to polyethylenimine polymer repeat unit)

was dissolved and reacted with benzyl chloride as defined in (d) above to obtain a reaction product.

ELECTROPLATING EXAMPLES

EXAMPLE I

A "J" shaped polished steel panel was cleaned and plated with a thin cyanide copper coating. The coated panel was rinsed and then plated in an acid plating bath having the composition:

220 g/l $CuSO_4\ 5H_2O$
60 g/l $H_2SO_4$
10 mg/l HCl
15 mg/l $HSO_3-(CH_2)_3-S-S-(CH_2)_3-SO_3H$
10 mg/l Polyethylene glycol M.W. 9,000

The panel was plated for 20 minutes at 40 amps per square foot using air agitation and a temperature of about 25° C. The resultant plated panel was uneven and generally dull.

EXAMPLE II

A second "J" shaped polished steel panel was cleaned, coated and then plated in a bath having the composition of Example I, except for the addition thereto of:

0.5 mg/l of the reaction product of example (c) above.

The resultant panel was mirror bright, even and had improved leveling characteristics.

EXAMPLE III

A "J" shaped polished steel panel was cleaned and coated as in Example I, and then was electroplated in an acidic copper bath having the composition:

| Ingredient | Ounces/Gal. |
|---|---|
| Copper metal [from $Cu(BF_4)_2$] | 2 |
| $HBF_4$ (100%) | 20 |

| | Parts/Million |
|---|---|
| $CH_3-C_6H_4-S-S-C_6H_3-CH_3-SO_3H$ | 20 |
| Polyethylene glycol (mol. wt. about 6,000) | 10 |
| Reaction product of Example (d) above | 1 |
| HCl | 30 |

The plated panel was bright and even with good leveling.

EXAMPLE IV

A "J" shaped polished steel panel was cleaned and coated as in Example I, and then was electroplated in a bath having the composition:

| Ingredient | Ounces/Gal. |
|---|---|
| $CuSO_4 . 5H_2O$ | 10 |
| $H_2SO_4$ (100%) | 20 |

| | Parts/Million |
|---|---|
| Dithio-Carbamate-S-Propane sulfonic acid | 15 |
| Ethoxylated Lauryl Alcohol with 15 moles Ethylene oxide | 50 |
| Reaction product of example (a) above | 0.4 |

The plated panel had a full bright, well leveled copper plate evenly deposited thereon.

What is claimed is:

1. A bath for electrodepositing copper comprising an aqueous acidic copper plating bath having dissolved therein about 0.04 to 1000 mg/l of a reaction product of an alkoxylated polyalkylenimine with an alkylating agent as defined below:

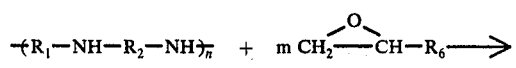

-continued

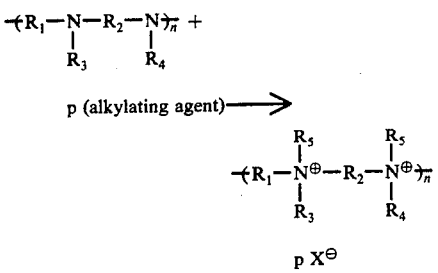

wherein:

$R_1$ = alkylene group of 1–6 carbon atoms;

$R_2$ = alkylene group of 1–6 carbon atoms;

$R_3 = -CH_2-\overset{OH}{\overset{|}{CH}}-R_6$ ;

$R_4 = -CH_2-\overset{OH}{\overset{|}{CH}}-R_6$ or H;

$R_5$ = alkyl group of 1–4 carbon atoms;

aralkyl;

alkenyl group of 2–4 carbon atoms;

alkynyl group of 2–4 carbon atoms;

alkylene sulfonate group of 1–4 carbon atoms (e.g. $-CH_2CH_2CH_2SO_3^{\ominus}$); and $-CH_2-\overset{OH}{\overset{|}{CH}}-CH_2\ N^{\oplus}(R_7)_3\ X^{\ominus}$ (e.g. $-CH_2\ \overset{OH}{\overset{|}{CH}}-CH_2\ N^{\oplus}(CH_3)_3\ Cl^{\ominus}$)

$R_6$ = H, $-CH_3$, $-CH_2OH$;

$R_7$ = alkyl group of 1–4 carbon atoms;

$m$ = 1 to 2;

$X^{\ominus}$ = $Cl^{\ominus}$, $Br^{\ominus}$, $CH_3SO_4^{\ominus}$;

$p$ = 1 to 2 and $n$ = 7.0 to 23,500.

2. A bath as defined in claim 1, in which the reaction product is an alkoxylated polyalkylenimine with an alkylating agent selected from the group consisting of benzyl chloride, allyl bromide, propanesultone, dimethyl sulfate and (3-chloro-2 hydroxypropyl) trimethyl ammonium chloride.

3. A bath as claimed in claim 2, wherein there is also present 0.01 to 5.0 g/l of a bath soluble polyether compound and 0.0005 to 1.0 g/l of an organic divalent sulfur compound selected from aliphatic polysulfides and organic sulfides carrying at least one sulfonic group.

4. A bath as claimed in claim 2, wherein there is also present a polyether compound in an amount within the range of about 0.01 to 5.0 g/l and 0.0005 to 1.0 g/l of an organic divalent sulfur compound.

5. A bath as defined in claim 1, wherein the alkylene oxide used to synthesize the alkoxylated polyalkylenimine is selected from the group consisting of ethylene oxide, propylene oxide and glycidol.

6. A bath as defined in claim 1, wherein $R_1$ and $R_2$ are defined as ethylene.

* * * * *